US008866015B2

(12) United States Patent
Efraimsson et al.

(10) Patent No.: US 8,866,015 B2
(45) Date of Patent: Oct. 21, 2014

(54) POWER CABLE WITH CONDUCTING OUTER MATERIAL

(75) Inventors: Lars Efraimsson, Falun (SE); Ivar Lars Sune Hansson, Falun (SE); Ulf Fridtjof Johnsen, Falun (SE)

(73) Assignee: NKT Cables Group A/S, Brondby (DK)

( * ) Notice: Subject to any disclaimer, the term of this patent is extended or adjusted under 35 U.S.C. 154(b) by 196 days.

(21) Appl. No.: 13/640,080

(22) PCT Filed: Apr. 9, 2010

(86) PCT No.: PCT/SE2010/050389

§ 371 (c)(1),
(2), (4) Date: Oct. 9, 2012

(87) PCT Pub. No.: WO2011/126418

PCT Pub. Date: Oct. 13, 2011

(65) Prior Publication Data

US 2013/0025906 A1 Jan. 31, 2013

(51) Int. Cl.
*H01B 9/02* (2006.01)
*H01B 7/18* (2006.01)

(52) U.S. Cl.
CPC . *H01B 9/02* (2013.01); *H01B 7/184* (2013.01)
USPC ..... 174/102 R; 174/103; 174/113 R

(58) Field of Classification Search
CPC ..... H01B 7/184; H01B 9/02
USPC ... 174/102 R, 102 SP, 102 D, 102 C, 102 SC, 174/34, 103, 104, 105 R, 105 B, 107, 113 R
See application file for complete search history.

(56) References Cited

U.S. PATENT DOCUMENTS

| | | | | |
|---|---|---|---|---|
| 3,571,613 | A * | 3/1971 | Plate et al. | 307/147 |
| 3,666,877 | A * | 5/1972 | Arnaudin et al. | 174/115 |
| 4,956,523 | A * | 9/1990 | Pawluk | 174/107 |
| 7,637,298 | B2 * | 12/2009 | Spruell | 156/500 |

FOREIGN PATENT DOCUMENTS

GB 1178316 A 1/1970

* cited by examiner

*Primary Examiner* — Hoa C Nguyen
*Assistant Examiner* — Amol Patel
(74) *Attorney, Agent, or Firm* — Buchanan Ingersoll & Rooney PC

(57) ABSTRACT

A power cable comprises at least one insulated cable core having an electric conductor, a screen and an outer insulating sheath surrounding the core/cores, and an outer conducting material attached to the exterior of the outer sheath. The outer conducting material includes at least one band attached to the outer sheath extending along the full length of the cable and having a width (W) extending over only a part of an outer periphery of the cable. At least one groove extends along the cable outer sheath and the band/bands of conducting material are received in the groove/grooves, or at least one rib extends along the cable outer sheath and the band/bands of conducting material are attached to an outer surface of said rib/ribs; or at least one band of the outer conducting material is adhered to the outer sheath and requires a stripping force.

9 Claims, 6 Drawing Sheets

FIG. 8
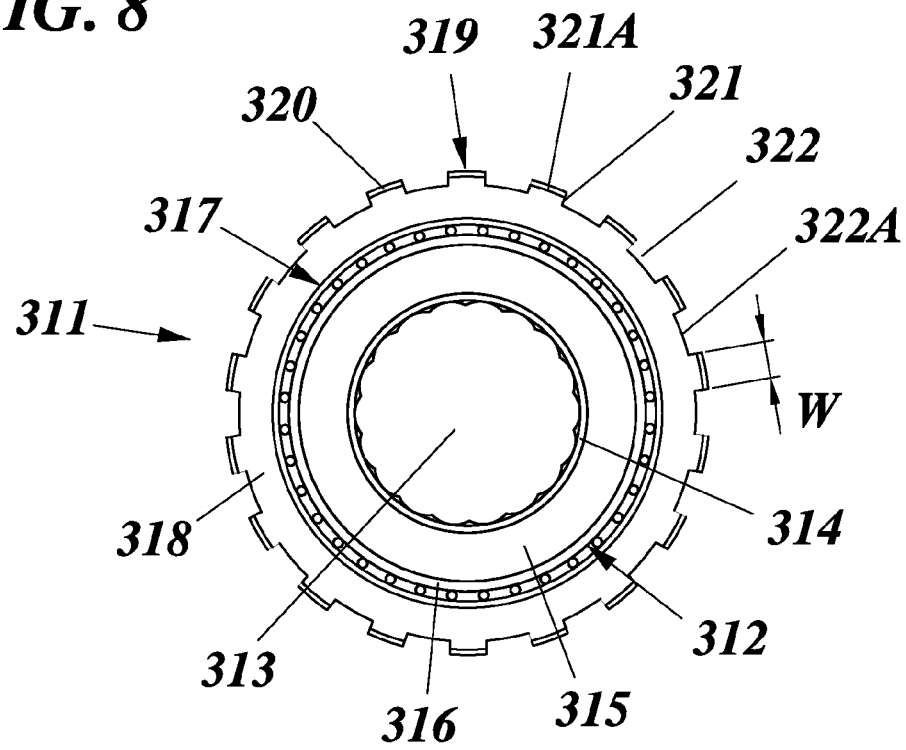
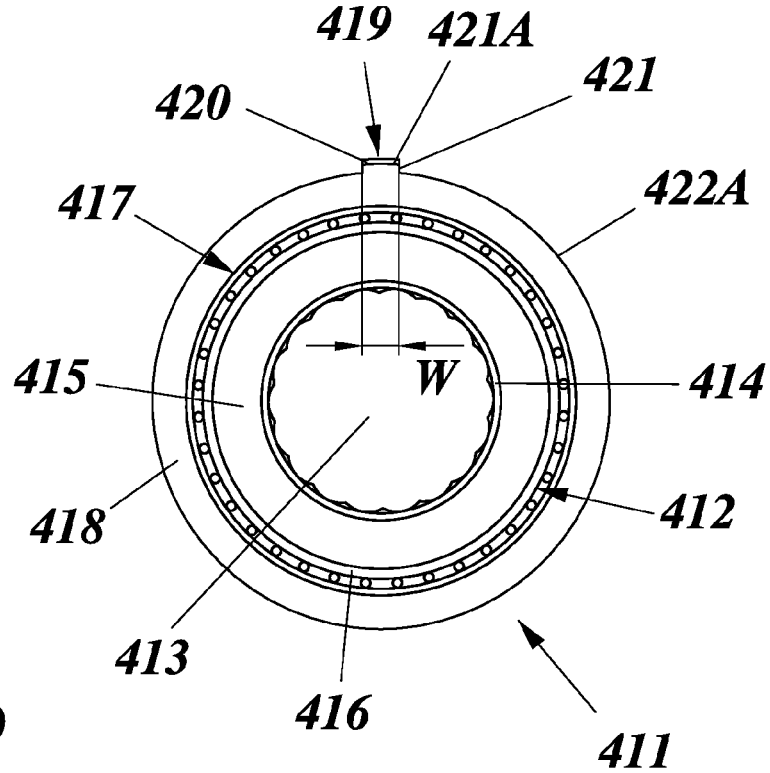
FIG. 9

POWER CABLE WITH CONDUCTING OUTER MATERIAL

CROSS REFERENCE TO RELATED APPLICATIONS

This application is a 35 U.S.C. §371 National Phase Entry Application from PCT/SE2010/050389, filed Apr. 9, 2010, designating the United States, the disclosure of which is incorporated herein in its entirety by reference.

TECHNICAL FIELD

The present invention concerns power cables in general and specifically relates to power distribution cables for installations underground, in water, in ducts or overhead.

BACKGROUND

Power distribution cables are provided with an outer sheath of insulating material and it is common practice to check the insulation of the outer cable sheath before the cable is put into operation. Normally, a test voltage of e.g. between 5 and 15 kV is used to apply an electric potential across the outer sheath in order to verify that its insulating properties are intact. In practice, for underground cables, this is done by applying the electric potential between a screen located underneath the outer sheath and the ground surrounding the cable.

In installations where the power cables are not laid under ground or are laid e.g. in a plastic tube it has been a recent and quite frequent requirement that cables shall have an outermost conducting layer or jacket that is applied to the insulating outer cable sheath surrounding the cable core or cores. In fact, it is generally desirable to provide such outer conducting jackets also in most underground installations, where ground contact may often be inferior due to air pockets around the cable or due to very dried out ground surrounding the cable.

The purpose of such conducting jackets is to enable the described checking of the insulation of the outer cable sheath in the absence of the surrounding ground or by the described conditions of inferior ground contact. It is thus common practice to provide round, generally circular-section power cables with such an outermost conducting jacket surrounding the outer periphery of the cable. This jacket is firmly interconnected with the sheath material and is in fact normally extruded simultaneously with the sheath material in a double extruder. A short length of such an outermost conducting jacket will have to be removed at cable joints and cable terminations to avoid flashover at the edge of the insulating sheath.

Outer conducting jackets of the existing types are normally not used for power cables having a non-circular cross section, such as the common 3 core cables. Since milling tools or similar tools requiring a round surface can not be used for such non-round cables it would be very difficult and time consuming to effectively remove such outermost conducting jackets from them at cable joints and terminations. Accordingly, today there is no method available for the effective, rational removal of an outer conducting jacket from such non-round cables.

The removal of an outermost conducting jacket is not without problems even for generally round cables and may thus have consequences. It is normally performed by means of the above indicated type of milling or other tools that can be used for cables having a generally circular cross section. However, a drawback of using such tools is that they may leave residue of the conducting jacket. It is often difficult to visually determine that all conducting material has been effectively removed and remaining residue may cause problems with regard to accurately performing the described insulation check voltage test. Such conducting layer residue could potentially also cause problems like the above mentioned risk of flashover at cable joints and terminations. It has therefore been suggested to produce the conducting jacket in a color that is easily distinguishable from that of the standardized black outer insulating sheath. This is an unwanted complication since the conducting jacket will normally be black for the technical reason of achieving the required electrical conductivity.

SUMMARY

A general object of the present invention is to provide a solution to the described problems.

A specific object is to provide an improved power cable having practical and effective outer conducting material applied thereto.

This and other objects are met by embodiments defined by the accompanying patent claims.

The invention relates to power cables of the type comprising at least one insulated cable core having an electric conductor and a screen and an outer insulating cable sheath surrounding the core or cores. Conducting material is attached to the exterior of the outer cable sheath. In a basic configuration the conducting material consists of at least one band that is attached to the outer cable sheath extending along the full length of the cable and having a width extending over only a part of an outer periphery of the cable. Thereby, at least one groove is extended lengthwise along the cable outer sheath and the band or bands of conducting material are accommodated in the groove or grooves; or alternatively at least one rib is extended lengthwise along the outer sheath and the band or bands of conducting material are attached to an outer surface of the rib or ribs; or alternatively at least one band of outer conducting material is adhered to the outer sheath requiring a stripping force of between 40-100 N according to the standard CELENEC HD605S1 to separate from the outer sheath.

This basic configuration presents the advantages of:

- universal application by cables of different cross-section.
- secure residue-free removal of conducting material from cables of optional shape; and
- protection for the conducting material against being removed during installation.

Advantages offered by the present invention, in addition to those described, will be readily appreciated upon reading the below detailed description of embodiments of the invention.

BRIEF DESCRIPTION OF THE DRAWINGS

The invention and its further objects and advantages will be best understood by reference to the following description taken together with the accompanying drawings, in which:

FIG. 8 is a schematical cross section through a forth embodiment of a power cable of the invention as applied to the cable type of FIG. 1A;

FIG. 9 is a schematical cross section through a variation of the power cable of FIG. 8.

DETAILED DESCRIPTION

The power cable of the invention will be explained with reference to exemplifying embodiments that are illustrated in accompanying drawing FIGS. 2-10. It is emphasized that these illustrations have the single purpose of describing exemplary embodiments of the invention and are not intended to limit the invention to the details thereof. Said embodiments all relate to an application of the inventive solution to medium voltage power distribution cables that are predominantly laid underground, in water or in ducts, but that may likewise be used for overhead installations. Examples of such power cables of the general type where the invention may be applied, are outlined in FIGS. 1A and 1B.

Figure 1A:
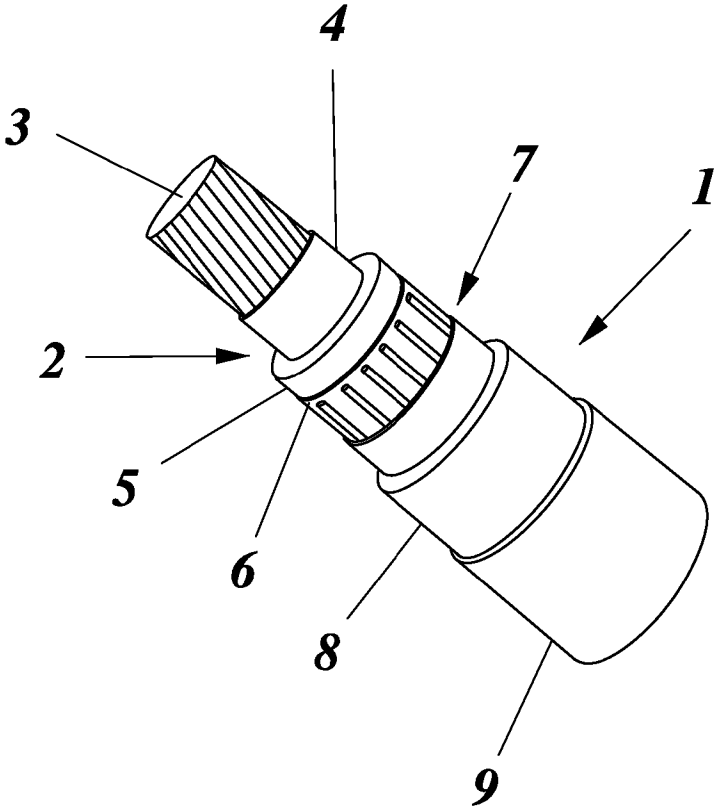
FIG. 1A is a partial and schematical illustration of a generic single conductor power cable.
Figure 1B:
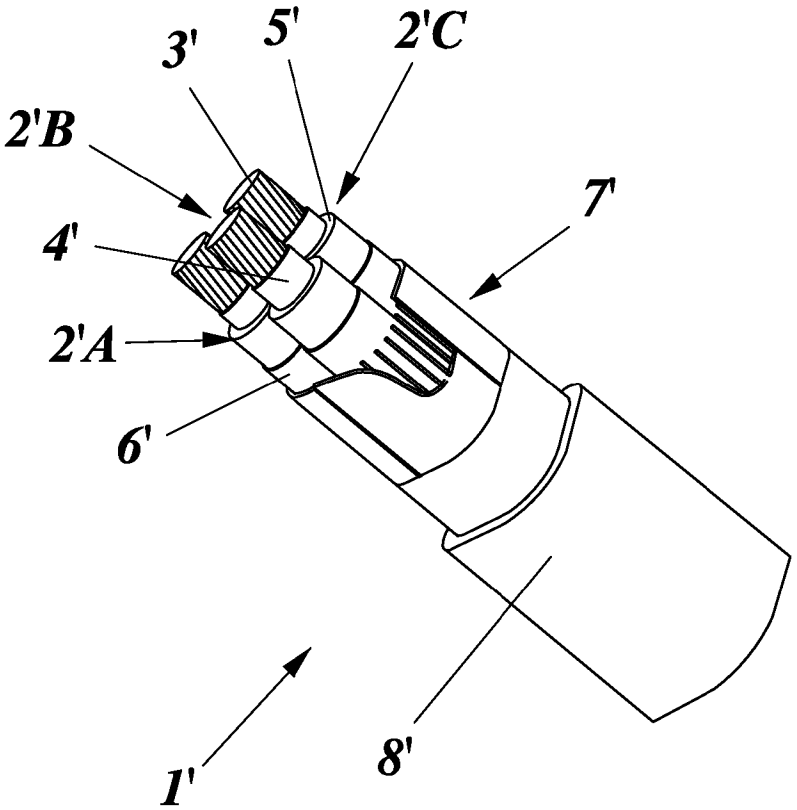
FIG. 1B is a partial and schematical illustration of a generic three conductor power cable.

Briefly, such power cables 1, 1' are of two general types comprising one single cable core 2 (FIG. 1A), or several, usually three, cable cores 2'A-2'C (FIG. 1B). Conventionally, the cable cores 2, 2'A-2'C each comprise a central conductor 3, 3', an inner conducting layer 4, 4', a conductor insulation 5, 5', an outer conducting layer 6, 6', a screen 7, 7' and an outer cable insulation sheath 8, 8'. For round single core cables 1 having a generally circular cross section it has been common practice to provide a further outermost conducting jacket 9 surrounding the cable 1. As discussed above, this outermost conducting layer 9 has been used to improve reliability of the sheath insulation voltage tests performed in cooperation with the screen 7. Specifically, this outermost conducting layer 9 serves to establish excellent grounding conditions also in situations where cables are not laid under ground or are laid in ground providing inferior grounding contact with the cables.

The invention intends to solve the problems that were discussed in the introduction and that generally relate to the common use of a surrounding outermost conducting jacket 9 bonded to the outer cable sheath 8 of round cables 1. The problems basically consist in that the conducting jacket 9 can not be universally used for cables 1' having a non-round cross section. Such conducting jackets 9 must be sufficiently bonded to the cable outer sheath 8 to withstand the fairly rough handling of the cables as they are laid out, especially in installations under ground. Effective removal of such bonded surrounding conducting jackets would be virtually impossible in combination with cables 1' having a non-round cross section.

To overcome such shortcomings and problems associated with the conventional solution, a new approach is proposed for applying conducting material on the outer insulating cable sheath. The basic concept of this solution is the provision of one or more separate bands of conducting material, each extending lengthwise along the entire cable and having only a limited extension in a direction around the circumference of the cable. Such a configuration is equally well suited for use on cables of varying cross-sectional shapes.

The inventive solution also creates basic conditions for enabling practical and residue-free removal of conducting material from a variety of cable types and shapes. As was indicated in the introduction even the removal of the conventional surrounding jacket from a round cable may have consequences. It is normally performed by means of a milling tool that may leave residue of the conducting layer, thereby causing the discussed problems with regard to accurately performing the described insulation check voltage test.

The invention also creates conditions for laying out cables without risking tearing off the conducting material. In exemplary further developments of the basic inventive concept the proposed conducting material band or bands may therefore be accommodated in associated grooves formed in the outer cable sheath material. The bands are received in the recessed grooves so that they are at a lower level than the sheath material surrounding the grooves and are strippable or simply removable therefrom using moderate force. Alternatively the band or bands may be bonded in a fixed connection to associated ribs formed of cable outer sheath material so as to be raised from the remainder of the sheath. In a further alternative the band or bands may be adhered directly to the outer cable sheath so as to be strippable therefrom using considerable force.

Figure 2:
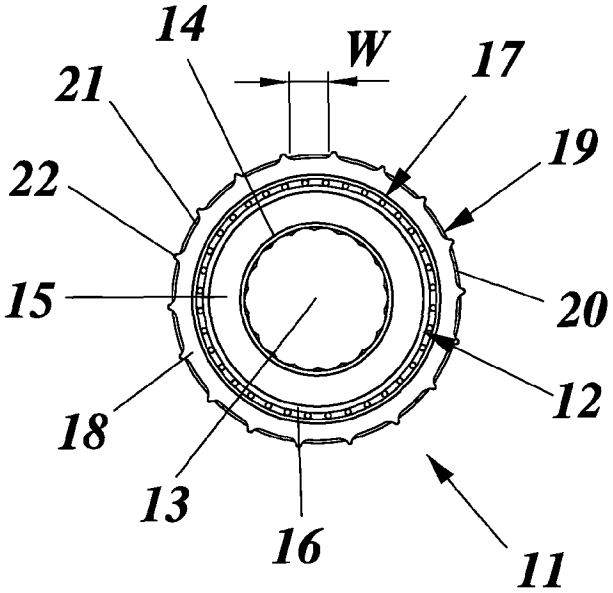
FIG. 2 is a schematical cross section through a first embodiment of a power cable of the invention as applied to the cable type of FIG. 1A.
Figure 3:
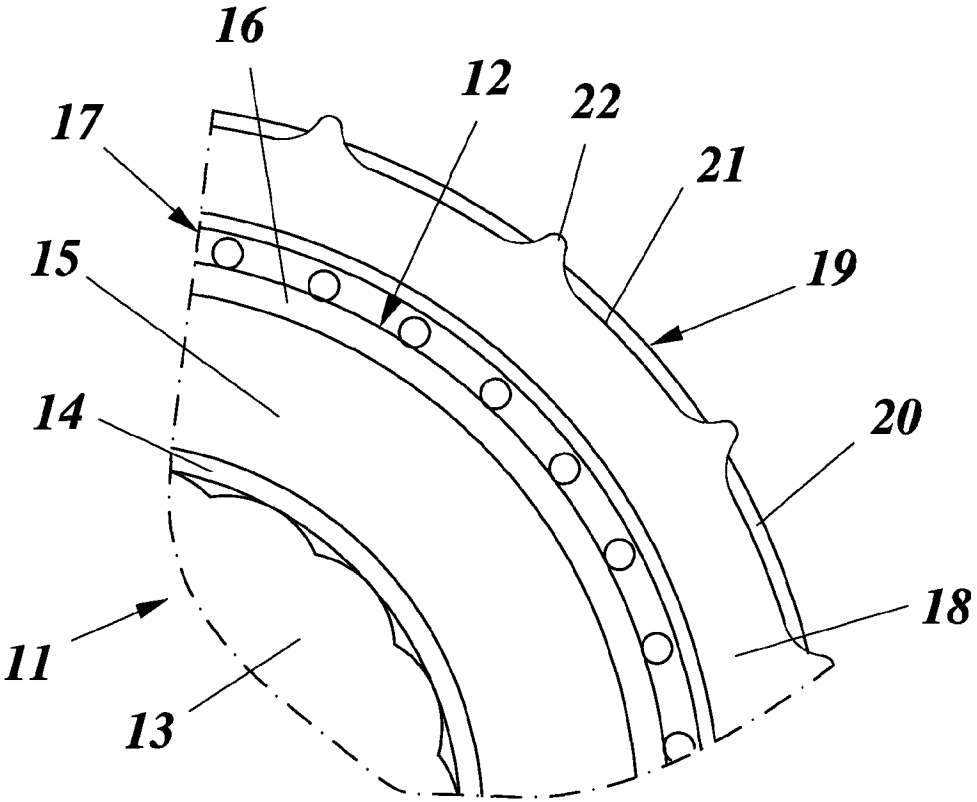
FIG. 3 is an enlarged partial cross section through the power cable of FIG. 2.

In FIGS. 2 and 3 is illustrated a first exemplary embodiment of a power cable 11 to which the basic concept of the invention has been applied. The cable 11 comprises a single insulated cable core 12 of the common configuration described above. In other words, it includes an electric conductor 13 surrounded by an inner conducting layer 14, an insulation layer 15, an outer conducting shield layer 16, a screen 17 and an outer cable insulation sheath 18. To the exterior of the outer sheath 18 is attached outer conducting material 19 constituted by several generally parallel bands 20. These bands are attached to the outer sheath 18 extending continuously along the full length of the cable 11. The bands each have a width W extending over only a part of an outer periphery of the cable. The bands 20 are provided side by side and are separated from each other by a distance that may be chosen e.g. depending upon the number of separate bands 20.

The bands 20 of outer conducting material 19 are each received in a separate associated groove 21 formed in the outer cable sheath 18 and extending lengthwise along the cable outer sheath 18. The grooves 21 are deeper than the thickness of the bands 20 so that the latter are fully accommodated in said grooves. The grooves 21 are separated by ridges 22 formed of areas of the outer sheath 18 that surround the grooves 21 and that extend outwardly past the actual bands 20. These ridges 22 of outer cable sheath material 18 thereby protect the bands 20 against unintentional removal during laying out of the cable 11. In other words, the ridges 22 are formed of mechanically much stronger material and support the cable as it is pulled on the ground or similar, so that the weaker conducting material 19 bands 20 are relieved from any load. Should the conducting material 19 still be damaged during installation, such damages will become much smaller since the strong material of the ridges 22 restricts the extension of such damages. The width W of the bands 20 and their separating distance are not vital for the function of the conducting material 19 but are chosen to provide optimal protection for the bands as well as practical manual removal thereof. This applies to all embodiments of the invention where bands of conducting material are received in a groove.

When forming cable joints and terminations, a short length of the conducting material must be removed, for the reasons discussed above. In this embodiment as well as in all of the embodiments illustrated in FIGS. 4-7, the bands are simply intended to be gripped with the fingers and torn off. They are pulled out from the associated groove 21 and stripped from the outer sheath material 18. The bands 20 are in this embodiment preferably adhered to the sheath material 18 in the grooves 21 requiring a stripping force that may be adjusted to enable residue-free removal of the individual bands 21 in this way. The stripping force shall also be chosen so as to ensure that the bands 20 of conducting material 19 do not come loose at normal handling of the cable 11. In practical embodiments this stripping force that is required to separate the bands 20 from the outer sheath 18 is preferably chosen to be between 5 and 40 N according to the standard CELENEC HD605S1. As is conventional, such stripping forces may be achieved e.g. by attaching the bands 20 to the sheath 18 by means of a double-bond adhesive applied between the sheath 18 and the conducting material 19 or by means of adhesive extruded between the outer sheath and the conducting material. Furthermore, the outer conducting material 19 may in such practical embodiments consist of material having another polarity than that of the outer sheath 18, such as e.g. Polyethylene (PE) to EVA or Polyethylene to PVC. In such pairings PE, EVA or PVC is only a component in the strippable conducting material. In practical applications the strippable outer conducting material bands may have a thickness of between 0.1 and 1.5 mm and may have an electrical conductivity that does not exceed 100 000 Ω·m.

Figure 4:
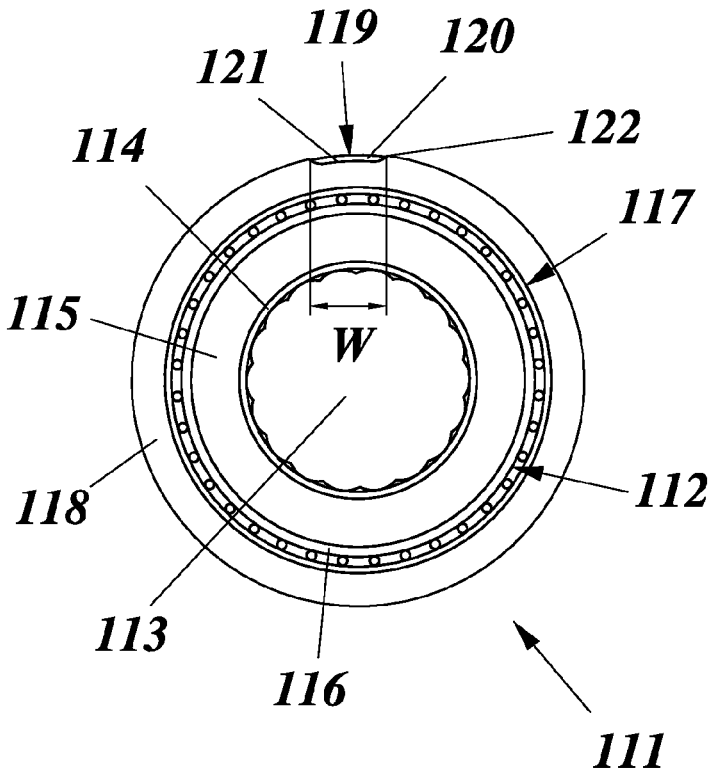
FIG. 4 is a schematical cross section through a variation of the power cable of FIG. 2.

FIG. 4 serves to illustrate that in an extreme variation of the first embodiment the cable 111 sheath 118 may have only one longitudinal groove 121 extending lengthwise along the cable sheath 118 and accommodating a single band 120 of conducting material 119. This single groove 121 may be optionally positioned around the outer periphery of the sheath 118 and a single ridge 122 is formed by the entire periphery of the outer sheath 118 that surrounds the groove 121. Otherwise, the cable 111 and conducting material 119 are basically similar to those of FIGS. 2 and 3 and the ridge 122 serves the same purpose as the ridges therein.

Figure 5:
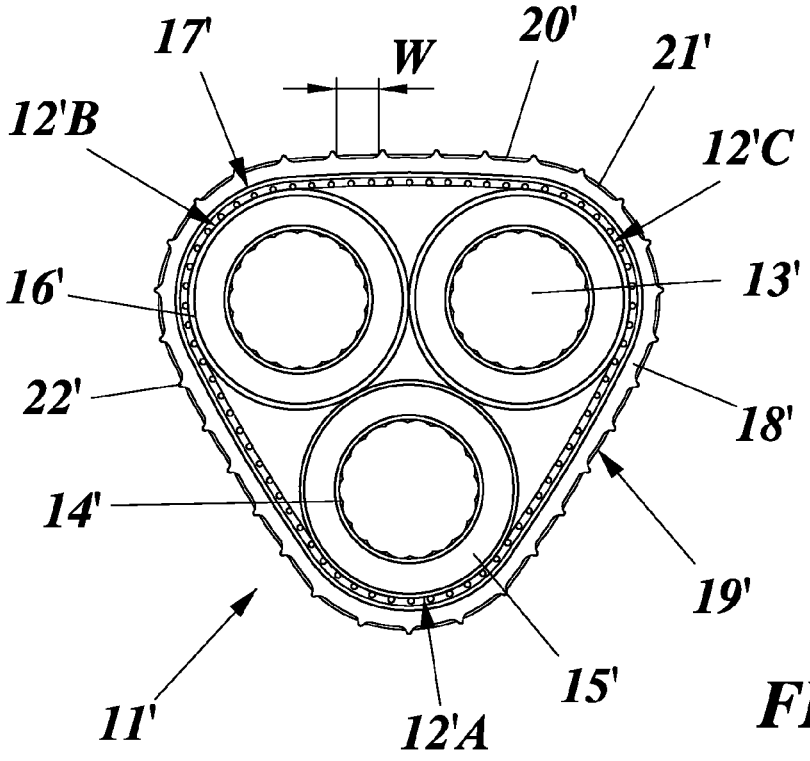
FIG. 5 is a schematical cross section through a second embodiment of the cable of the invention, as applied to the cable type of FIG. 1B.

In FIG. 5 is illustrated a second exemplary embodiment that concerns an application of the general conducting material configuration of FIGS. 2 and 3 to the general type of multi core cable 1' of FIG. 1B. This cable 11' comprises three insulated cable cores 12'A-12'C of the common configuration wherein each core 12'A-12'C includes an electric conductor 13' surrounded by an inner conducting layer 14', an insulation layer 15' and an outer conducting shield layer 16'. All cable cores 12'A-12'C are surrounded by a common screen 17' and outer cable insulation sheath 18'. Here, bands 20' of conducting material 19' are again attached to the sheath 18' extending the full length of the cable 11' and each having a width W extending over only a part of an outer periphery of the cable 11'. Band receiving grooves 21' and ridges 22' are formed in the cable outer sheath 18' like in the first embodiment and for the same purpose. With this configuration of the conducting material 19' and of the outer sheath 18', the bands 20' may be readily removed also from a non-round power cable 11'. The bands 20' are likewise well protected by the ridges 22'. This will be easily noted by studying FIG. 5.

Figure 6:
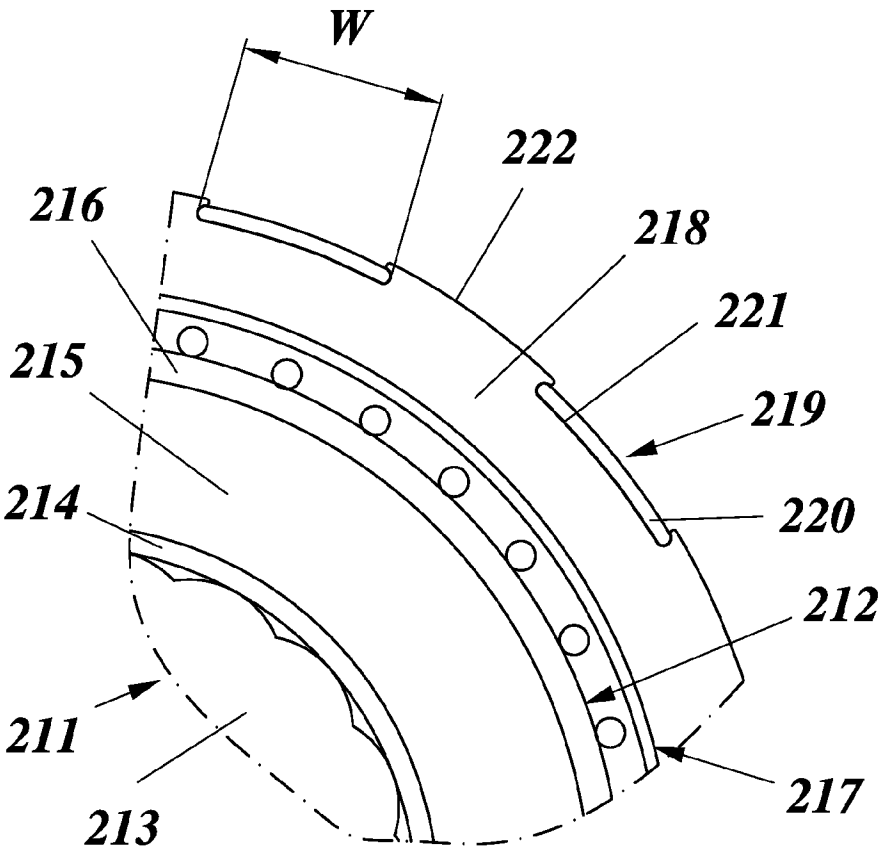
FIG. 6 is a schematical and partial cross section through a third embodiment of a power cable of the invention as applied to any of the cable types of FIGS. 1A and 1B.
Figure 7:
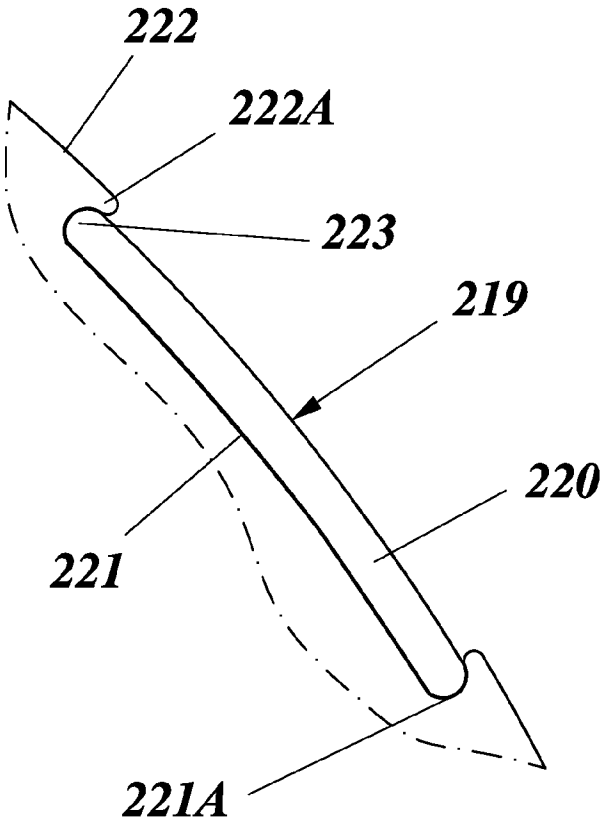
FIG. 7 is a detailed, enlarged illustration of an outer peripheral part of the power cable of FIG. 6.

FIGS. 6 and 7 partially disclose a third exemplary embodiment of a power cable 211 that may be either a single or a multi core cable. This embodiment employs a variant of the groove configurations of FIGS. 2-3 and 5 and provides even better protection for the bands 220 against being damaged when laying out the cable 211. Here, separate bands 220 of the outer conducting material 219 are again each received in a separate associated groove 221 formed in the outer sheath 218. In this case the grooves 221 have an undercut groove portion 221A at each longitudinal side thereof. The undercut portions 221A are each extended in under associated areas 222 extending outwardly past the actual bands 220 of conducting material. These areas 222 form ridges that separate adjacent grooves 221 and that are much wider than the ridges illustrated in FIGS. 2-3 and 5. Longitudinal edges 223 of the separate bands 220 of the outer conducting material 219 are nested in said undercut portions 221A of the grooves 221. The separating ridges 222 and specifically their edge portions 222A overlie and shelter the associated edges 223 of the bands 220 to provide excellent protection against damages when the cable 211 is laid out. In other words, by allowing outer sheath material 218 to flow out so that it overlies the edges 223 of the bands 220 the bands are protected even further, still allowing them to be pulled out manually from the grooves 221. In fact, in this embodiment it is possible to attach the bands 220 to the cable outer sheath 218 only by the mechanical retention in the grooves. In other words, edges 223 of the bands may be retained removably in and by the undercut groove portions 221 so that no adhesive or other bonding is required. Although this is not illustrated, it should also be understood that this third embodiment may likewise be varied with regard to the number of provided grooves and ridges. A single groove, single band and single ridge variant like the one illustrated in FIG. 4 may thus be contemplated also for this embodiment.

FIG. 8 illustrates a forth exemplary embodiment of a power cable 311 of the invention. In this case separate bands 320 of outer conducting material 319 are attached to associated ribs 321 having outer surfaces 321A that are raised above the surrounding exterior areas 322A of the outer cable sheath 318. The ribs 321 are preferably formed of the material of the outer cable sheath 318. The bands 320 of conducting material 319 are attached to the outer surface 321A of the ribs 321 and the ribs 321 together with the attached bands 320 are easily peelable from the remainder of the outer sheath 318 by using an appropriate peeling or cutting tool (not shown).

The ribs 321 are distributed around the outer circumference of the outer sheath 318 and are each extended lengthwise along the cable outer sheath 318. The ribs 321 protrude a distance above the actual cable sheath 318. This distance is somewhat exaggerated in FIG. 8 (as well as in FIG. 9) but shall be sufficient to allow the use of a suitable tool, e.g. even a knife, to remove the ribs 321. In particular, the ribs 321 are mutually separated by channels 322 being sufficiently wide to allow manipulation of a peeling or cutting tool to remove at least the major portion of the ribs 321 along with the bands 320 attached thereto. The bottom 322A of the channels 322 corresponds to the exterior of the outer sheath 318 and may thereby be used as a guide to ensure that excessive rib/sheath material is not removed but that all conducting material 319 is safely removed. To avoid unintentional removal or damage of the exposed bands 320 of conducting material 319 they are bonded in a fixed connection to their separate associated rib 321 of the outer sheath 318. Preferably, the bands 320 of conducting material are extruded onto the rib 321 outer surfaces 321A.

FIG. 9 illustrates an extreme variation of the embodiment of FIG. 8. In this variant the cable 411 sheath 418 has only one longitudinal rib 421 extending lengthwise along the cable sheath 418. The single rib 421 may be optionally positioned around an outer periphery of the outer sheath 418. A single band 420 of conducting material 419 is bonded to the single rib 421 that protrudes out from the surrounding exterior surface 422A of the cable sheath 418. Otherwise, the cable 411 and the conducting material 419 as well as its bonding to the rib 421 are basically the same as in the FIG. 8 embodiment. The rib 421 is removed in basically the same manner.

The described first to forth embodiments are all based on the common concept of providing cables having an outer insulation sheath that at the outer circumference is provided with alternating recessed grooves and protruding ridges or with alternating recessed channels and protruding ribs, and wherein bands of conducting material are provided recessed in and raised from, respectively, the adjacent surrounding portions of the sheath.

Figure 10:
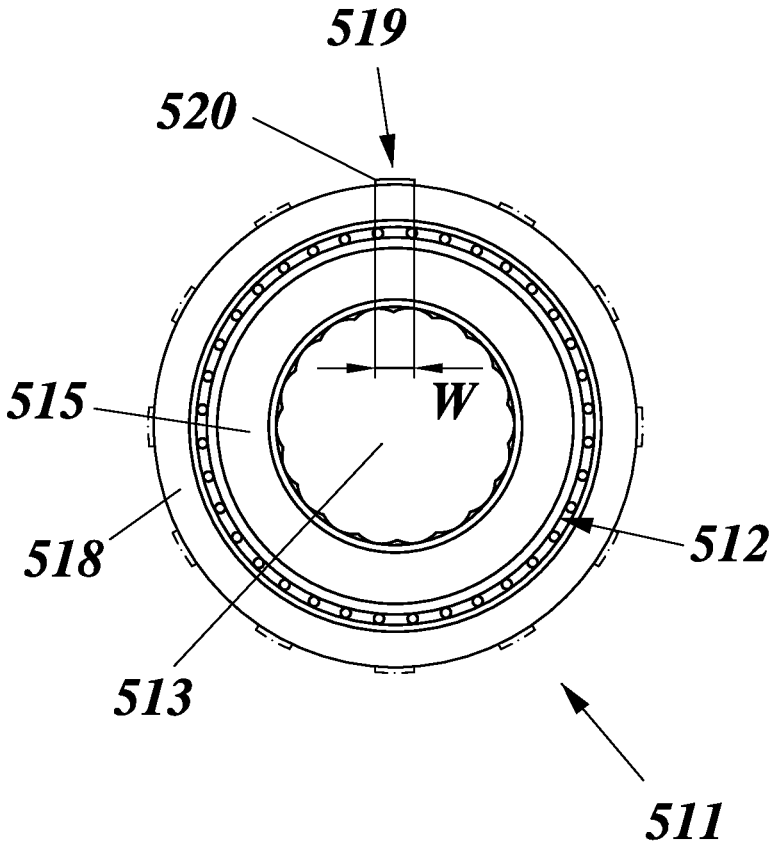
FIG. 10 is a schematical cross section through a fifth embodiment of a power cable of the invention as applied to the cable type of FIG. 1A.

Finally, FIG. 10 illustrates a fifth embodiment of the invention, as applied to a round cable 511 of the general type shown in FIG. 1A. In this case one or several (illustrated in dash-dot lines) bands 520 of conducting material 519 are adhered directly to the exterior of the outer cable sheath 518. In order to achieve the desired protection against unintentional removal and still enable manual residue-free intentional removal the band or bands 520 of the outer conducting material 519 are adhered or bonded to the outer sheath 518 so that a stripping force of between 40 and 100 N according to the standard CELENEC HD605S1 is required to separate the conducting material from the outer sheath 518. The bands 520 may preferably be coextruded with the outer cable sheath 518 in a manner that is known per se. In an alternative further development of this embodiment a metal tape having a backing of suitable adhesive could be employed for the bands 520.

In alternative, but not specifically illustrated embodiments of the invention variations of the different illustrated embodiments of the cable according to the invention may be employed without departing from the scope of the invention. Examples thereof may be that in embodiments having several separate bands of conducting material received in grooves, bonded to ribs or adhered directly to the outer sheath, the bands may be provided in optional numbers and positions. In other words, the bands may be randomly or optionally distributed around the circumference of the cable or may alternatively be equally separated, regularly or evenly distributed around the outer circumference of the cable outer sheath. The actual number of bands or their positioning may depend upon conditions of the actual applications.

The invention has been described in connection with a number of embodiments that are to be regarded as illustrative examples of the invention. It will be understood by those skilled in the art that the invention is not limited to the disclosed embodiments but is intended to cover various modifications and equivalent arrangements. The invention likewise covers any feasible combination of features of the various described and illustrated embodiments of the present invention. The scope of the invention is defined by the appended claims.

The invention claimed is:

1. A power cable comprising at least one insulated cable core having an electric conductor, a screen and an outer insulating cable sheath surrounding the at least one insulated cable core, and conducting material attached to the exterior of the outer cable sheath, wherein:

the conducting material includes at least one band attached to the outer sheath extending along the full length of the cable and having a width extending over only a part of an outer periphery of the cable; and wherein the power cable includes:

at least one groove extending lengthwise along the cable outer sheath, the at least one band of conducting material being accommodated in said at least one groove; or at least one rib extending lengthwise along the cable outer sheath, the at least one, band of conducting material being attached to an outer surface of said at least one rib; or at least one band of the outer conducting material being adhered to the outer sheath and requiring a stripping force of between 40 and 100N according to the standard CELENEC HD605S1 to separate from the outer sheath.

2. A power cable according to claim 1, wherein a single band of the outer conducting material is accommodated in an associated single groove that is optionally positioned around an outer periphery of the outer sheath, or is attached to an associated single rib that is optionally positioned around an outer periphery of the outer sheath, or is adhered to the cable outer sheath at an optional position around an outer periphery thereof.

3. A power cable according to claim 1, wherein separate bands of the outer conducting material are each received in a separate associated groove in the outer sheath, or are each attached to a separate associated rib on the outer sheath, or are adhered to the cable outer sheath at separate positions around an outer periphery thereof.

4. A power cable according to claim 3, wherein the separate bands of the outer conducting material and, if applicable, the associated grooves and ribs, are equally separated, evenly distributed around the outer circumference of the outer sheath, or are optionally positioned around the outer circumference of the outer sheath.

5. A power cable according to claim 1, wherein at least one band of the outer conducting material is fully accommodated in said at least one groove, with areas of the cable outer sheath that separate the at least one groove extending outwardly past the at least one band, forming ridges that protect the at least one band against unintentional removal during laying of the cable.

6. A power cable according to claim 5, wherein the at least one groove has an undercut groove portion at each longitudinal side thereof, said undercut portion being extended under an associated separating ridge, and longitudinal edges of the at least one band of the outer conducting material are nested in said undercut portions of the at least one groove with edge portions of the separating ridges overlying and sheltering the associated edges of the at least one band.

7. A power cable according to claim 5, wherein the at least one band of the outer conducting material is attached to the cable outer sheath inside said at least one groove requiring a stripping force of between 5 and 40 N according to the standard CELENEC HD605S1 to separate from the outer sheath.

8. A power cable according to claim 7, wherein the at least one band of the outer conducting material is attached to the outer sheath by a double-bond adhesive applied between the outer sheath and the outer conducting material or by adhesive extruded between the outer sheath and the outer conducting material.

9. A power cable according to claim 1, wherein the at least one band of the outer conducting material is bonded in a fixed connection to a separate associated rib of the outer sheath.

* * * * *